US006657481B2

(12) United States Patent
Rasmussen et al.

(10) Patent No.: US 6,657,481 B2
(45) Date of Patent: Dec. 2, 2003

(54) CURRENT MIRROR CIRCUIT

(75) Inventors: Carsten Rasmussen, Copenhagen (DK); Ivan Riis Nielsen, Farum (DK)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/127,465

(22) Filed: Apr. 23, 2002

(65) Prior Publication Data

US 2003/0197549 A1 Oct. 23, 2003

(51) Int. Cl.[7] ..... G05F 1/10; G05F 3/02
(52) U.S. Cl. ..... 327/540; 323/315
(58) Field of Search ..... 327/538, 540, 327/541, 543; 323/312, 315, 316

(56) References Cited

U.S. PATENT DOCUMENTS 4,692,711 A * 9/1987 Miyasako ..... 330/257
4,769,619 A * 9/1988 Taylor ..... 330/288
5,808,508 A * 9/1998 Castellucci et al. ..... 327/538
5,926,060 A 7/1999 Olgaard et al. ..... 327/538

OTHER PUBLICATIONS

M. Horenstein: "Microelectronics Circuits & Devices", sections 7.8–7.10, pp. 302–314, Prentice Hall, Inc., 1990, ISBN 0–13–584673–0.

* cited by examiner

*Primary Examiner*—Terry D. Cunningham
*Assistant Examiner*—Quan Tra
(74) *Attorney, Agent, or Firm*—Antonelli, Terry, Stout & Kraus, LLP

(57) ABSTRACT

A current mirror circuit has an input portion including a first transistor, which is adapted to establish a reference current. It also has an output portion including a second transistor, and a control portion between the input portion and the output portion. The control portion includes a third transistor coupled for controlling the second transistor to generate an output current which is a function of the reference current while inhibiting current leakage from the input portion to the output portion. A lowpass filter is included in the control portion to prevent noise in the input portion from influencing the second transistor.

19 Claims, 4 Drawing Sheets

CURRENT MIRROR CIRCUIT

FIELD OF THE INVENTION

The present invention relates to current source biasing circuitry for various electronic devices, including but not limited to electronic circuitry in mobile telecommunication terminals. More specifically, the present invention relates to a current mirror circuit having an input portion with a first transistor, an output portion with a second transistor, and a control portion between the input portion and the output portion for controlling the second transistor to generate an output current which is a function of a reference current established by the first transistor.

BACKGROUND ART

Generally, biasing serves to establish a selected operating range in the voltage-current characteristics of non-linear devices such as transistors and diodes, so that gross non-linearities of the non-linear devices will be avoided and so that, therefore, the non-linear devices will behave like or resemble linear devices.

Current source biasing serves to provide a constant DC current source for the circuit to be biased. Current mirrors provide current source biasing which is substantially independent of device temperatures and device parameters, such as the forward DC current gain $\beta_f$ of a bipolar junction transistor (BJT), or the conductance parameter (K) and the threshold voltage ($V_{TR}$) for a field-effect transistor (FET). Current mirrors are described in detail in sections 7.8–7.10, pp 302–314 of "Microelectronic Circuits & Devices", by Mark N Horenstein, Prentice-Hall, Inc., 1990, ISBN 0-13-584673-0, incorporated herewith by reference.

As is shown in FIG. 2, a prior art current mirror uses a pair of first and second three-terminal devices T1 and T2, coupled "back-to-back" with their input ports connected in parallel. T1 and T2 may be of arbitrary type but are illustrated as bipolar junction transistors in FIG. 2. T1 and T2 are connected to ground through their emitter terminals and first and second resistors R1, R2, respectively. The transistor T1 and resistor R1 form an input portion 152, which receives an input current $i_{in}$ and establishes a reference current $i_{ref}$. Correspondingly, the transistor T2 and resistor R2 form an output portion 154, which serves to supply an output current $i_{out}$ to a circuit 160 to be biased. To this end, a control portion 156 is formed between the input portion 152 and the output portion 154.

In the prior art solution according to FIG. 2, the control portion 156 simply consists of a connection between the collector terminal of transistor T1 and the base terminal of transistor T2, having a drawback in that some current $i_t$ will be stolen from the input current $i_{in}$ to control the transistors T1 and T2.

In another prior art solution, shown in FIG. 3, the above is remedied by introducing a third transistor T3 into the circuit. Transistor T3 is biased trough $V_{cc}$ and will enable the current mirror to operate without stealing current from $i_{in}$. The transistor T3 may be, for instance, a bipolar junction transistor or an NMOS field-effect transistor. If T3 is a bipolar junction transistor, the stolen current $i_t$ will be close to 0, and if T3 is an NMOS, $i_t$ will equal to 0 (wherein $i_{ref}$ will be equal to $i_{in}$).

However, the present inventors have identified a remaining problem with the prior art solution according to FIG. 3. At node 164 in the input portion 152, when looking both towards transistor T1 and towards input node 162, the impedances seen will be very high, particularly when BIC-MOS circuits are used. Therefore, any noise introduced at node 164 will go entirely across the control portion 156 to transistor T2 in the output portion 154, thereby corrupting the output signal at node 166. Corruptions in the output signal mean that the following circuit 160 will not be biased with a perfect DC current source, and if this circuit is designed to rely on a perfect DC current source, the operation thereof may be jeopardized.

SUMMARY OF THE INVENTION

In view of the above, an objective of the invention is to solve or at least reduce the problems discussed above and to provide an improved current mirror technique compared to the prior art.

Generally, the above objective is achieved by a current mirror circuit according to the attached independent claim.

Thus, a first embodiment of the invention concerns a current mirror circuit comprising: an input portion including a first transistor, wherein the first transistor is adapted to establish a reference current; an output portion including a second transistor; and a control portion between the input portion and the output portion, the control portion including a third transistor coupled for controlling the second transistor to generate an output current which is a function of the reference current while inhibiting current leakage from the input portion to the output portion.

The objective of the invention has been achieved, in the first embodiment, by introducing a lowpass filter in the control portion prior to the third transistor. The lowpass filter will filter the signal that controls the second transistor, thereby allowing any noise from the input portion to be filtered out before it is amplified by the second transistor to generate the output current. Additionally, including the lowpass filter within the current mirror circuit has an advantage compared to external filtration outside/after the current mirror, since additional power would be consumed in the latter case.

In a second, more sophisticated embodiment, the lowpass filter is an RC filter which, as its resistive part, comprises a fourth transistor which is biased by a feedback loop into a state of high impedance. The state of high impedance may be the resistive (also known as triode or ohmic) region of operation for the fourth transistor, which may be a PMOS field-effect transistor.

Using a PMOS field-effect transistor instead of a resistor in an RC filter is advantageous for the following reasons. Due to the very high impedances in the input portion, a resistor would need to be very large (in the order of 1 GΩ) to establish a proper low filtering frequency. However, resistors with such high impedance are very hard to build. Alternatively, the capacitor in the RC filter could be made very large, but that would be very costly because of the physical size of a large capacitor—silicon chip space is very expensive.

Moreover, by selecting a PMOS transistor, the gate-source voltage for the third transistor can be chosen so that it is sufficient to bias the fourth transistor, wherein no other components are necessary. By biasing the fourth transistor in a feedback loop, the ohmic characteristics thereof will be stabilized. Consequently, this embodiment of the invention overcomes a known problem in the technical field—because of the inherently irregular (non-linear) ohmic characteristics of a PMOS transistor it is difficult to include a PMOS transistor in a lowpass filter of RC type.

In either of the embodiments the third transistor may be an NMOS field-effect transistor or another type of field-effect transistor. The first and second transistors may be bipolar junction transistors, but essentially any other three-terminal devices would also do.

In a third embodiment, the lowpass filter comprises a plurality of cascaded RC filters, each of which has a PMOS field-effect transistor as its resistive part. This arrangement allows efficient noise filtering at a low component cost.

Generally, the current mirror circuit according to the invention may be included in any application using current mirrors. In one embodiment the current mirror circuit according to the invention is included in a station for a mobile telecommunications network. The station may be a mobile terminal.

Other objectives, features and advantages of the present invention will appear from the following detailed disclosure, from the attached dependent claims as well as from the drawings.

Generally, all terms used in the claims are to be interpreted according to their ordinary meaning in the technical field, unless explicitly defined otherwise herein. All references to "a/an/the [element, device, component, etc]" is to be interpreted openly as referring to at least one instance of said element, device, component, etc., unless explicitly stated otherwise. As used herein, the term "transistor" embraces all electronic three-terminal devices having a constant-current region, unless explicitly stated otherwise.

BRIEF DESCRIPTION OF THE DRAWINGS

Some embodiment of the present invention will now be described in more detail, reference being made to the enclosed drawings, in which.

DETAILED DISCLOSURE OF EMBODIMENTS

Before giving a detailed description of the three embodiments shown in FIGS. 4, 5 and 6, FIG. 1 will provide an overview of a telecommunication system and a mobile terminal used therein, as one example of an electronic device in which the present invention may be included.

Figure 1:
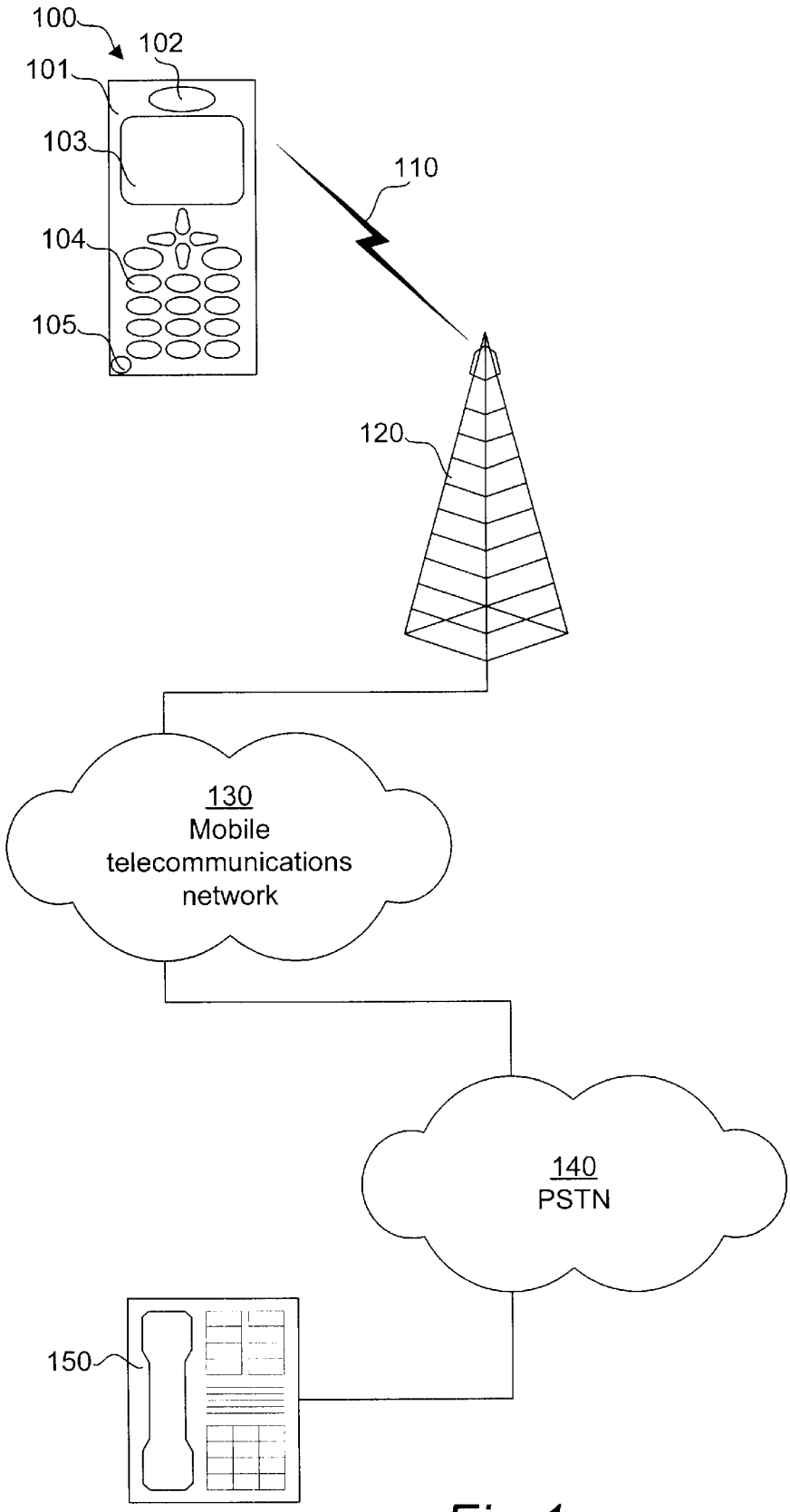
FIG. 1 is a schematic illustration of a telecommunications system, in which the present invention may be applied.
Figure 2:
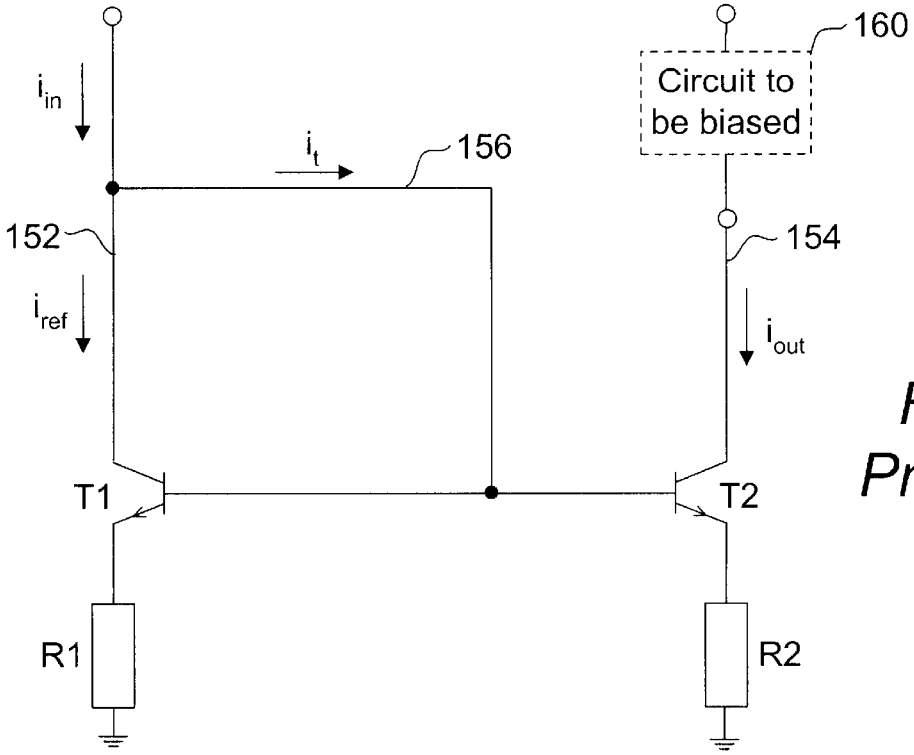
Fig 2 Prior art
FIG. 2 is a schematic block diagram of a current mirror circuit according to the prior art.

In the telecommunication system of FIG. 1, a mobile terminal 100 is connected across a wireless communication link 110 to a base station 120 of a mobile telecommunications network 130. The mobile telecommunications network 130 is connected to another telecommunications network 140, a public switched telephone network (PSTN). In this way, a user of the mobile terminal 100 may communicate with another user of a stationary telephone 150. The mobile terminal may be any commercially available device—such as a mobile (cellular) telephone, a portable digital assistant (PDA), a communicator, a paging device, or a palmtop computer having a telecommunications interface—which is adapted for any known mobile telecommunications system, such as GSM, UMTS or D-AMPS.

As is well known in the art, the mobile terminal 100 comprises an apparatus housing 101, a loudspeaker 102, a display 103, a keypad 104 with navigation keys as well as alphanumeric keys, and a microphone 105. In addition, but not shown in FIG. 1, the mobile terminal 100 comprises various components, such as a built-in or external antenna, a radio transceiver, a speech encoder/decoder, a channel encoder/decoder, a processing device (CPU), an electronic memory, and various segments of software code, which are stored in the memory and are executed by the processing device so as to perform the various functions and operations of the mobile terminal 100. As is well known, the radio transceiver comprises various analog and digital electronic components, such as power amplifiers, filters, local oscillators and mixers, which together will modulate an outgoing audio signal onto a carrier wave, that is emitted as electromagnetic waves propagating from the antenna of the mobile terminal 100, as well as receive incoming radio signals and demodulate them into incoming audio signals.

Figure 3:
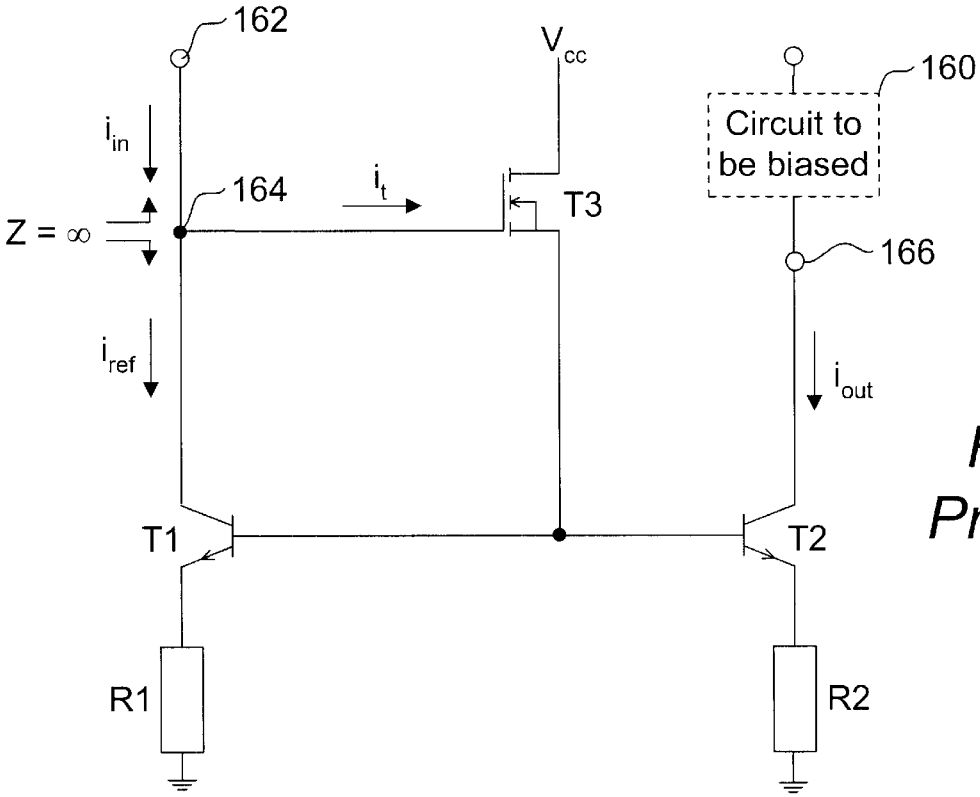
Fig 3 Prior art
FIG. 3 is a schematic block diagram of another current mirror circuit according to the prior art.
Figure 4:
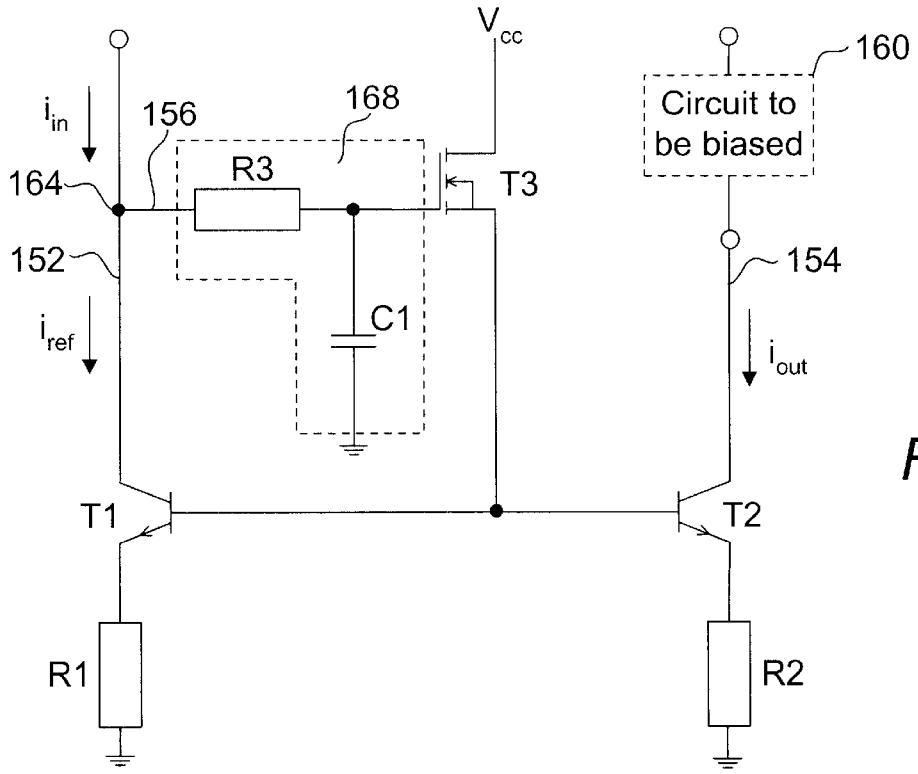
FIG. 4 is a schematic block diagram of a current mirror circuit according to a first embodiment.

Reference will now be made to FIG. 4, which illustrates the first embodiment of the current mirror circuit according to the invention. In common with the prior art circuit of FIG. 3, which was discussed above in the Background section, the current mirror circuit of the first embodiment uses a pair of first and second bipolar junction transistors T1 and T2, coupled "back-to-back" with their base terminals interconnected and grounded through their emitter terminals and first and second resistors R1, R2, respectively. The transistor T1 and resistor R1 form an input portion 152, which receives an input current $i_{in}$ and establishes a reference current $i_{ref}$. Correspondingly, the transistor T2 and resistor R2 form an output portion 154, which supplies an output current $i_{out}$ to a circuit 160 to be biased. A control portion 156 is formed between the input portion 152 and the output portion 154 and includes a third transistor T3. The if transistor T3 is biased trough $V_{cc}$ and will enable the current mirror to operate without stealing current from $i_{in}$. The transistor T3 is an NMOS field-effect transistor but may alternatively be another type of field-effect transistor.

In contrast to the prior art circuit of FIG. 3, the current mirror circuit of the first embodiment shown in FIG. 4 additionally comprises an internal lowpass filter 168 in the form of a first-order RC network having a resistive part and a capacitive part. Other lowpass filters are however also possible. In the first embodiment, the resistive part is constituted by a resistor R3, whereas the capacitive part is constituted by a capacitor C1. The lowpass filter 168 will filter the signal in the control portion 156 that controls the second transistor T2, thereby allowing any noise appearing at node 164 of the input portion 152 to be filtered out before it is amplified by the second transistor T2 to generate the output current $i_{out}$. Suitable component values for the lowpass filter 168 of the first embodiment may be R3≈1 GΩ and C1≈50 pF.

Figure 5:
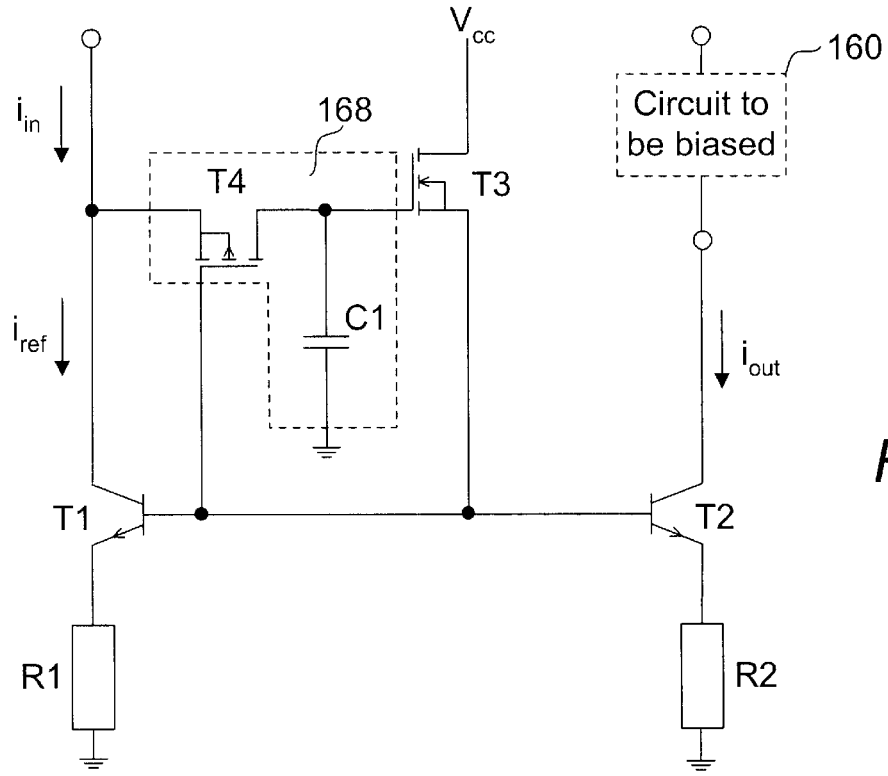
FIG. 5 is a schematic block diagram of a current mirror circuit according to a second embodiment.

In the second embodiment shown in FIG. 5, the resistive part of the lowpass filter 168, i.e. resistor R3 in FIG. 4, has been replaced by a fourth transistor T4, which is biased by a feedback loop into a state of high impedance. In the second embodiment, the fourth transistor is a PMOS field-effect transistor, wherein the state of high impedance is the resistive region of operation for transistor T4. As appears from FIG. 5, the feedback loop is formed by coupling the source terminal of the fourth transistor T4 to the collector terminal of the first transistor T1, coupling the gate terminal of the fourth transistor T4 to the base terminal of the first transistor T1, coupling the drain terminal of the fourth transistor T4 to the gate terminal of the third transistor T3 and coupling the source terminal of the third transistor T3 to the base terminal of the first transistor T1.

Using the PMOS field-effect transistor T4 instead of the resistor R3 in the lowpass filter 168 is advantageous for the following reasons. As previously described with reference to FIG. 3, the input portion 152 exhibits very high impedances. Therefore, a very large resistance is required for resistor R3 (in the order of 1 GΩ, as mentioned above) to establish a proper low filtering frequency. However, resistors with such a high impedance are hard to build and, thus, costly. As an alternative, the capacitor C1 in the lowpass filter 168 could be made very large, but that would be even more costly because of the physical size of a large capacitor; it is a well known fact that silicon chip space is very expensive.

Moreover, since the fourth transistor T4 is a PMOS field-effect transistor, the current mirror circuit of FIG. 5 is designed so that the offset current for the third transistor T3 is sufficient to bias T4, thereby avoiding any need for additional components.

An additional feature is that by biasing the fourth transistor T4 in a feedback loop, the ohmic characteristics thereof will be stabilized, wherein the general problem of irregular ohmic characteristics for PMOS transistors in their ohmic region is conveniently avoided.

A simplified equation for the transfer function of the lowpass filter 168 is:

$$\frac{I_{out}(s)}{I_{in}(s)} = \frac{N}{s^2 \cdot R_{T4} \cdot C_{C1} \cdot C_{par} / g_m + s \cdot (C_{par} + C_{C1} \cdot (1 + R_{T4} / R_{par})) / g_m + 1 + 1 / (R_{par} \cdot g_m)}$$

where:

$R_{T4}$ is the equivalent resistance of transistor T4, $C_{C1}$ is capacitance of the filter capacitor C1, $C_{par}$ is the parasitic capacitance at the input node 164, $R_{par}$ is the parasitic impedance at the input node 164, N is current mirror ratio, $g_m$ is given by $1/(R_e+(kT/q)/i_{in})=1/(R_e+25\text{ mV}/i_{in})$, where Re is the resistance of the emitter resistor R1 at the first transistor T1.

Typical component values for the first and second embodiments shown in FIGS. 4 and 5 may be:

| | |
|---|---|
| R1 | $V_{R1\ wanted}/i_{in}$ = (100 mV to 500 mV)/100 μA |
| R2 | $V_{R2\ wanted}/i_{out}$ = (100 mV to 500 mV)/2 mA |
| R3 | ~1 GΩ |
| $i_{in}$ | 100 μA |
| $i_{out}$ | 2 mA |
| C1 | 50 pF |
| $W_{T4}$ | 0.5 μm |
| $L_{T4}$ | 10 mm |

Even if the fourth transistor T4 advantageously is implemented as a PMOS field-effect transistor, T4 could alternatively be implemented as another type of field-effect transistor. However, such an alternative is presently believed to be of slighly less value (but still of some value), since the biasing of transistor T4 will be more complicated and therefore require an increase in silicon area by approximately 200–300% for the biasing due to the extra circuitry needed.

The sizes of the first and second transistors T1 and T2 will depend on the actual circuitry that the current mirror is to be a part of but are generally determined by Area(T1)/Area (T2)=$i_{out}/i_{in}$.

Figure 6:
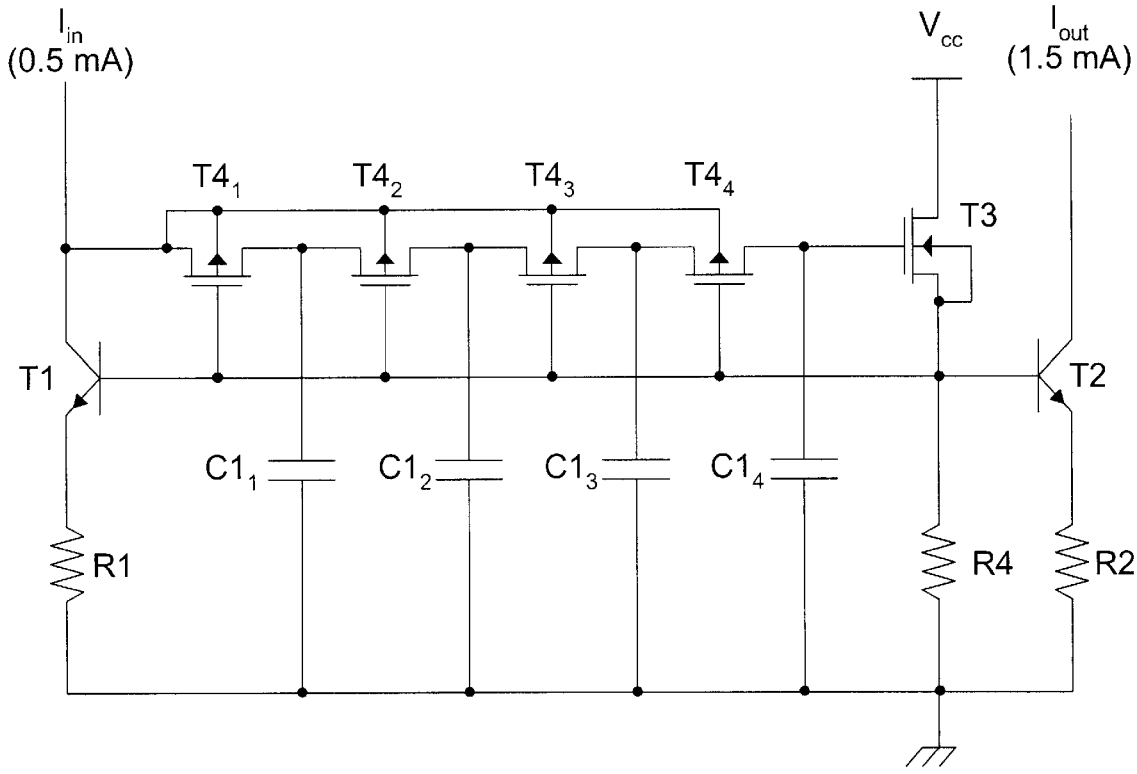
FIG. 6 is a schematic block diagram of a current mirror circuit according to a third embodiment.

The arrangement according to the second embodiment of FIG. 5 may be broadened into the third embodiment, shown in FIG. 6, where the lowpass filter 168 is cascaded in a series of transistor/capacitor pairs $T4_1/C1_1$, $T4_2/C1_2$, $T4_3/C1_3$, $T4_4/C1_4$ between the input portion and the output portion. The current mirror circuit of FIG. 6 comprises an additional resistor R4, having a resistance of 3650Ω and serving to ensure a well defined current flow in the NMOS transistor T3. Capacitors $C1_1$, $C1_2$ and $C1_3$ are 2 pF each, whereas capacitor $C1_4$ is 16.5 pF. $T4_1$, $T4_2$, $T4_3$ and $T4_4$ are 5/40 (channel width/channel length) PMOS field-effect transistors and represent approximately 30 MΩ each in the lowpass filter. Resistors R1 and R2 are 300Ω and 100Ω, respectively, causing $i_{out}$ to be 1.5 mA for $i_{in}$=0.5 mA. T1 is formed by 2 NPN elements in parallel, each having an emitter area of 0.5 μm×1.6 μm, whereas T2 is formed by 6 NPN elements in parallel, also having an emitter area of 0.5 μm×1.6 μm each.

The invention has mainly been described above with reference to a few embodiments. However, as is readily appreciated by a person skilled in the art, other embodiments than the ones disclosed above are equally possible within the scope of the invention, as defined by the appended patent claims. Various current mirror topologies are possible without departing from the spirit of the invention, including the ones referred to as the Widlar current source and the Wilson current source in the aforesaid sections of "Microelectronic Circuits & Devices". Moreover, the invention may be embodied in various electronic equipment in addition to mobile terminals, including but not limited to portable digital assistants (PDAs), palmtop computers, laptop computers, desktop computers, electronic calendars, paging devices, navigation devices (such as GPS receivers), video game consoles, portable audio players (such as MP3, CD or compact cassette players, or FM radios), etc.

What we claim and desire to secure by Letters Patent is:

1. A current mirror circuit comprising:

an input portion including a first transistor, wherein the first transistor is adapted to establish a reference current;

an output portion including a second transistor;

a control portion between the input portion and the output portion, the control portion including a third transistor coupled for controlling the second transistor to generate an output current which is a function of the reference current while inhibiting current leakage from the input portion to the output portion; and a lowpass filter included in said control portion, wherein the lowpass filter is an RC filter and comprises, as its resistive part, a fourth transistor which is biased by a feedback loop into a state of high impedance.

2. A current mirror circuit as in claim 1, wherein said state of high impedance is a resistive region of operation for the fourth transistor.

3. A current mirror circuit as in claim 1, wherein said fourth transistor is a PMOS field-effect transistor.

4. A current mirror circuit as in claim 3, wherein said third transistor is an NMOS field-effect transistor.

5. A current mirror circuit as in claim 4, wherein said first and second transistors are bipolar junction transistors.

6. A current mirror circuit as in claim 5, the lowpass filter further comprising a capacitor, wherein:

a base terminal of the first transistor is coupled to a base terminal of the second transistor;

an emitter terminal of the first transistor is coupled to ground through a first resistor;

an emitter terminal of the second transistor is coupled to ground through a second resistor;

a source terminal of the fourth transistor is coupled to a collector terminal of the first transistor;

a gate terminal of the fourth transistor is coupled to a base terminal of the first transistor;

a drain terminal of the fourth transistor is coupled to a gate terminal of the third transistor;

a first side of the capacitor is coupled between the drain terminal of the fourth transistor and the gate terminal of the third transistor;

a second side of the capacitor is grounded;

a drain terminal of the third transistor is coupled to a voltage supply line;

a source terminal of the third transistor is coupled to a node between the base terminal of the first transistor and the base terminal of the second transistor; and a collector terminal of the second transistor forms an output terminal for said output current.

7. A current mirror circuit as in claim 1, wherein the lowpass filter comprises a plurality of cascaded RC filters.

8. A current mirror circuit as in claim 7, wherein each RC filter in the plurality of cascaded RC filters comprises a PMOS field-effect transistor as its resistive part.

9. A current mirror circuit as in claim 1, wherein said lowpass filter is adapted to prevent noise in the input portion from influencing the second transistor.

10. A mobile terminal in a mobile telecommunications network, the mobile terminal having a current mirror circuit comprising:

an input portion including a first transistor, wherein the first transistor is adapted to establish a reference current;

an output portion including a second transistor;

a control portion between the input portion and the output portion, the control portion including a third transistor coupled for controlling the second transistor to generate an output current which is a function of the reference current while inhibiting current leakage from the input portion to the output portion; and a lowpass filter included in said control portion, wherein the lowpass filter is an RC filter and comprises, as its resistive part, a fourth transistor which is biased by a feedback loop into a state of high impedance.

11. A station as in claim 10, wherein the station is a mobile terminal.

12. A mobile terminal according to claim 10, wherein said state of high impedance is a resistive region of operation for the fourth transistor.

13. A mobile terminal according to claim 10, wherein said fourth transistor is a PMOS field-effect transistor.

14. A mobile terminal according to claim 10, wherein said third transistor is an NMOS field-effect transistor.

15. A mobile terminal according to claim 10, wherein said first and second transistors are bipolar junction transistors.

16. A mobile terminal according to claim 10, the lowpass filter further comprising a capacitor, wherein:

a base terminal of the first transistor is coupled to a base terminal of the second transistor;

an emitter terminal of the first transistor is coupled to ground through a first resistor;

an emitter terminal of the second transistor is coupled to ground through a second resistor;

a source terminal of the fourth transistor is coupled to a collector terminal of the first transistor;

a gate terminal of the fourth transistor is coupled to a base terminal of the first transistor;

a drain terminal of the fourth transistor is coupled to a gate terminal of the third transistor;

a first side of the capacitor is coupled between the drain terminal of the fourth transistor and the gate terminal of the third transistor;

a second side of the capacitor is grounded;

a drain terminal of the third transistor is coupled to a voltage supply line; a source terminal of the third transistor is coupled to a node between the base terminal of the first transistor and the base terminal of the second transistor; and a collector terminal of the second transistor forms an output terminal for said output current.

17. A mobile terminal according to claim 10, wherein the lowpass filter comprises a plurality of cascaded RC filters.

18. A mobile terminal according to claim 10, wherein each RC filter in the plurality of cascaded RC filters comprises a PMOS field-effect transistor as its resistive part.

19. A mobile terminal according to claim 10, wherein said lowpass filter is adapted to prevent noise in the input portion from influencing the second transistor.

* * * * *